US010450888B2

(12) United States Patent
Wulf et al.

(10) Patent No.: US 10,450,888 B2
(45) Date of Patent: Oct. 22, 2019

(54) GUIDE VANE SYSTEM FOR A TURBOMACHINE

(71) Applicant: MTU Aero Engines AG, Munich (DE)

(72) Inventors: Joachim Wulf, Munich (DE); Frank Stiehler, Bad Liebenwerda (DE)

(73) Assignee: MTU Aero Engines AG, Munich (DE)

( * ) Notice: Subject to any disclaimer, the term of this patent is extended or adjusted under 35 U.S.C. 154(b) by 336 days.

(21) Appl. No.: 15/417,959

(22) Filed: Jan. 27, 2017

(65) Prior Publication Data

US 2017/0226887 A1 Aug. 10, 2017

(30) Foreign Application Priority Data

Feb. 5, 2016 (DE) ..... 10 2016 201 766

(51) Int. Cl.

| | |
|---|---|
| ***F01D 17/16*** | (2006.01) |
| ***F04D 29/56*** | (2006.01) |
| ***F01D 9/04*** | (2006.01) |
| ***F01D 11/00*** | (2006.01) |

(52) U.S. Cl.

CPC ..... *F01D 17/162* (2013.01); *F01D 9/042* (2013.01); *F01D 11/003* (2013.01); *F04D 29/563* (2013.01); *F05D 2220/323* (2013.01); *F05D 2230/60* (2013.01); *F05D 2260/36* (2013.01)

(58) Field of Classification Search

CPC ..... F01D 17/162; F01D 9/042; F01D 11/003; F04D 29/563; F05D 2260/36; F05D 2220/323; F05D 2230/60

See application file for complete search history.

(56) References Cited

U.S. PATENT DOCUMENTS

| | | | | |
|---|---|---|---|---|
| 4,395,195 | A | 7/1983 | De Cosmo et al. | |
| 7,704,042 | B2 * | 4/2010 | Brueckner | F01D 9/042 415/121.3 |
| 2006/0056963 | A1 | 3/2006 | Abadie et al. | |
| 2007/0020093 | A1 | 1/2007 | Giaimo et al. | |

(Continued)

FOREIGN PATENT DOCUMENTS

| | | | | |
|---|---|---|---|---|
| EP | 1586744 | A2 | 10/2005 | |
| EP | 2211023 | A1 * | 7/2010 | F01D 9/023 |

(Continued)

*Primary Examiner* — Joseph J Dallo

(74) *Attorney, Agent, or Firm* — Barlow, Josephs & Holmes, Ltd.

(57) ABSTRACT

The invention relates to a guide vane system for a turbomachine with at least one guide vane, which can be rotatably mounted around an adjustment axis and is arranged with a radially inner end region in a corresponding recess of an inner ring, wherein the arrangement of the guide vane on the inner ring is secured by a securing element in a form-fitting manner. For an especially advantageous securing of this arrangement, it is provided that the securing element is designed as an oblong element, which is arranged at least in a recess and/or through-opening of the radially inner end region of the guide vane directed in the peripheral direction of the turbomachine and is arranged at least in a recess and/or through-opening of the inner ring directed in the peripheral direction of the turbomachine. In addition, the invention relates to a turbomachine, in particular an aircraft engine, and to a method for assembling a guide vane system.

12 Claims, 2 Drawing Sheets

(56) References Cited

U.S. PATENT DOCUMENTS

| | | | | |
|---|---|---|---|---|
| 2007/0068303 | A1* | 3/2007 | Bouru | F01D 17/20 74/469 |
| 2014/0212263 | A1* | 7/2014 | Hayford | F01D 5/28 415/1 |
| 2015/0275683 | A1* | 10/2015 | Humhauser | F01D 1/02 415/159 |
| 2016/0376957 | A1* | 12/2016 | Kulkarni | F01D 25/305 60/39.5 |
| 2017/0175756 | A1* | 6/2017 | Zotz | F01D 17/16 |
| 2017/0314406 | A1* | 11/2017 | Wolf | F01D 9/041 |

FOREIGN PATENT DOCUMENTS

| | | | | |
|---|---|---|---|---|
| EP | 2716874 | A1 | 4/2014 | |
| EP | 2884055 | A1 | 6/2015 | |
| EP | 2960438 | A1 | 12/2015 | |
| EP | 3176385 | A1 * | 6/2017 | F01D 9/041 |
| EP | 3203035 | A1 * | 8/2017 | F01D 9/042 |

* cited by examiner

GUIDE VANE SYSTEM FOR A TURBOMACHINE

The work that led to this invention was funded under Grant Agreement No. CSJU-GAM-SAGE-2008-001 as part of the European Union's Seventh Framework Program (FP7/2007-2013) for the Clean Sky Joint Technology Initiative.

BACKGROUND OF THE INVENTION

The invention relates to a guide vane system for a turbomachine in accordance with the present invention. The invention further relates to a turbomachine and to a method for assembling a guide vane system for a turbomachine.

Known from EP 2 884 055 A1 is a guide wheel for a turbomachine, for which guide vanes that are arranged in succession in the peripheral direction of the guide wheel and can be variably adjusted around their radially directed longitudinal axis are provided. An inner ring is arranged radially inward of the guide vanes. The guide vanes are mounted at their radially inner ends in respective recesses of the inner ring. In this case, at least one of the guide vanes has a sliding surface that is formed essentially perpendicular to the longitudinal axis and is arranged radially inward. The sliding surface and the inner ring form a frictional pairing. In this way, respective leakage at the bearing of the guide vane at the inner ring is especially reduced.

In this case, in order to secure the bearing of the guide vane at the inner ring, a securing pin, which is arranged in a plane perpendicular to the longitudinal axis of the guide vane, is joined to the radially inner end of the guide vane in a form-fitting manner. The variability of the guide vane and, in particular, its ability to twist around the longitudinal axis of the guide vane, is made possible in this case by means of a groove in the inner ring formed in the peripheral direction, in which the securing pin is guided. Each guide vane in this case is secured using a securing pin that is respectively associated with it. Alternatively, it is provided that the guide vanes are to be joined at their radially inner end in a form-fitting manner in the radial direction by means of a rivet connection or screw connection, which is arranged perpendicular to the longitudinal axis of the guide vane. Furthermore, there exists the possibility that a screw, which is arranged parallel to the longitudinal axis of the guide vane, is designed for fixing the inner ring in place at the radially inner-lying end of the guide vane. In these cases, too, a securing in the form of a rivet connection or a screw connection is provided for each guide vane. However, a drawback of the known securing systems is that, in this way, additional leakage pathways can be opened up in the axial direction, as a result of which the performance of the turbomachine is reduced.

SUMMARY OF THE INVENTION

The object of the present invention is to improve the securing of a guide vane system for a turbomachine. Furthermore, the object of the invention is to improve a turbomachine and to create an especially simple method for assembling a guide vane system for a turbomachine.

These objects are achieved in accordance with the invention by a guide vane system, by a turbomachine, and by a method for assembling a guide vane system of the present invention. Advantageous embodiments with appropriate enhancements of the invention are described in detail below, wherein advantageous embodiments of the guide vane system, the turbomachine, and the method for assembling the guide vane system are each to be regarded as reciprocally advantageous embodiments.

A first aspect of the invention relates to a guide vane system for a turbomachine with at least one guide vane that is mounted rotatably around an adjustment axis and is arranged with a radially inner end region in a corresponding recess of an inner ring, wherein the arrangement of the guide vane on the inner ring is secured in a form-fitting manner by means of a securing element.

In accordance with the invention, it is provided in this case that the securing element is designed as an oblong element, which is arranged at least in a recess and/or through-opening of the radially inner end region of the guide vane directed in the peripheral direction of the turbomachine and at least in a recess and/or through-opening of the inner ring directed in the peripheral direction of the turbomachine. This securing represents a reliable, form-fitting connection of a guide vane pin with the inner ring. As a result, it is made especially unlikely or even totally excluded that the inner ring comes off in the case of so-called pump surges, for example. Furthermore, no additional leakage pathways due to the respective recesses and/or through-openings are opened up in the axial direction, because said recesses and/or through-openings are directed in the peripheral direction. The form-fitting connection of the inner ring to the guide vane additionally suppresses the thermal deformation of the inner ring known as cording. In this way, any unnecessary wear of respective sealing elements arranged on the inner ring is prevented. Cording is caused, in particular, by transient thermal deformations of the inner ring and/or the guide vanes.

The guide vane system in this case can be part of a guide vane ring, which is referred to as a guide wheel. In particular, the guide vane system can comprise a plurality of guide vanes, each mounted rotatably around an adjustment axis, said guide vanes being arranged in succession in the peripheral direction. The respective adjustment axis of the guide vanes preferably corresponds in this case to a radial direction of the turbomachine. Preferably, the guide vane or the guide vanes is or are mounted on the inner ring and/or the inner ring is held at the guide vanes.

Preferably, the securing element is designed to prevent or at least limit to a certain maximum extent, by way of the arrangement in the respective recesses and/or through-openings, any relative radial movement of the guide vanes and the inner ring with respect to each other. The respective recesses and/or through-openings can be designed in this case such that either the guide vane, together with the securing element, can be rotated together around the adjustment axis within the inner ring or the guide vane can be rotated, without it being necessary to rotate the securing element as well. In this way, the ability to adjust and/or vary the guide vane is also ensured upon securing. Consequently, the guide vane can be further adjusted or rotated in a predefined range of angles, as a result of which the turbomachine can be operated at each point of operation with an especially high efficiency. Preferably, the guide vane system is installed in a low-pressure compressor or in a high-pressure compressor of aircraft engines.

The guide vane of the guide vane system can be designed as a truncated cone at its radial inner end region. This construction is characterized by a very small radial design height. This permits a design of each of the inner cavities of the inner ring and also of the turbomachine that is optimal in terms of leakage and, as a result, makes possible a design of a rotor assembly that is favorable overall in terms of structural mechanics. By contrast, for a radially inner end region that is designed as a bearing journal and is surrounded by the inner ring, increased leakage is expected to occur. In particular, it may be necessary in this case for the inner ring to have an axially divided design.

In addition, the recesses and/or through-openings can be aligned to one another. This means that each of the through-openings and/or recesses is arranged at least in partial overlap with respect to the other, so as to be able to guide the securing element in the peripheral direction through this recess and/or through-opening. In this case, the through-openings and/or recesses are preferably formed such that the guide vane still remains variable.

In another advantageous embodiment of the guide vane system according to the invention, it is provided that at least two guide vanes of the guide vane system are secured by means of a common securing element. In particular, one securing element can be utilized for jointly securing a large number of or all guide vanes. In this way, the expense for securing the arrangement of guide vanes on the inner ring drops quite substantially. It is no longer necessary to secure each individual guide vane separately. In particular, a securing element can be inserted into the inner ring in the peripheral direction for this purpose. This securing element can extend over the entire extension in the peripheral direction of the inner ring. As a result, the guide vane system can be mounted very rapidly and simply and, moreover, fewer parts are required. The joint securing of a plurality of guide vanes by means of a common securing element in this case is first made possible by the alignment of the respective recess and/or through-opening in the peripheral direction of the turbomachine in this simple form.

In another advantageous embodiment of the guide vane system according to the invention, it is provided that the recess of the guide vane is designed as a groove that runs outside at least in part around the radially inner end region of the guide vane. In this case, such a groove can be fabricated in a rapid and cost-effective manner. Moreover, by way of such a groove, the adjustment range of the guide vane is not restricted when the guide vane rotates around the adjustment axis. Moreover, the groove running around the periphery of the radially inner end region of the guide vane has an advantageous effect on the vibrational behavior of the guide vane during operation of the turbomachine. In addition, in the case of a groove running around the radially inner end region of the guide vane only in sections, the risk of leakage produced by the securing is minimized. The securing element can be supported radially outward and/or inward in the groove of the guide vane.

In another advantageous embodiment of the guide vane system according to the invention, it is provided that the securing element is designed as a securing wire that is round or rectangular in cross section and runs in the peripheral direction. A securing wire is a securing element that can be produced in an especially cost-effective manner and/or is especially light. Moreover, a securing wire can be adapted in an especially simple manner to the shape or the radius of the inner ring. Each of the recesses and/or through-openings can have a corresponding cross section at least in sections. A square cross section and, in particular, a rectangular cross section and a square, in particular rectangular, securing wire can be fabricated in this case in an especially cost-effective manner. A round cross section and/or a round securing wire are especially robust. In particular, on account of the acute angle in the radially inner end region of the guide vane and/or in the inner ring, no stress peaks occur.

In another advantageous embodiment of the guide vane system according to the invention, it is provided that the inner ring is undivided in the axial direction of the turbomachine. Such an inner ring can be fabricated in an especially cost-effective manner, requires no additional connecting elements in the axial direction, and exhibits no leakage through a gap running in the peripheral direction. Such an axially undivided inner ring is especially advantageous when the radially inner end region of the guide vane is designed as a truncated cone. In contrast to a radially inner end region with a bearing journal and a plate element for holding the guide vane on the inner ring, an end region formed in this way can be inserted without any problem into the corresponding recess of the inner ring. In particular also, no additional sleeves for mounting the guide vanes on the inner ring are then required.

In another advantageous embodiment of the guide vane system according to the invention, it is provided that the inner ring is divided into at least two inner ring segments in the peripheral direction of the turbomachine. For example, the guide vane system can have an inner ring with two inner ring segments extending over 180°. However, it is also possible for the inner ring to be composed of four 90-degree inner ring segments. An inner ring divided in the peripheral direction makes possible an especially simple assembly of the turbomachine. Moreover, it is possible in this way to provide an especially large inner ring, the diameter of which is not restricted by respective manufacturing equipment to a maximum diameter of a component that can be fabricated. Moreover, an inner ring divided in the peripheral direction makes possible an especially simple insertion of the securing element. The securing element can be threaded into an opening at a front end of the respective inner ring segment—that is, a face that is directed toward the next inner ring segment in the case of the assembled inner ring—in a simple manner in this way.

In another advantageous embodiment of the guide vane system according to the invention, it is provided that one securing element is provided for each inner ring segment. In this way, each of the securing elements can be mounted in an especially simple manner for inner rings divided in the peripheral direction. In particular, it is possible in each case to assemble a part of the guide vane system, composed of an inner ring segment, the respective associated guide vanes, and the associated securing element, and then simply assemble the inner ring and thus also the guide vane system by joining this inner ring segment to the guide vanes held thereon and the already mounted securing elements.

In another advantageous embodiment of the guide vane system according to the invention, it is provided that the inner ring is produced at least partially by means of an additive manufacturing method. In this way, it is possible to produce an inner ring with especially complex geometries, in particular with undercut recesses and/or through-openings, which cannot be produced using conventional manufacturing methods or can be produced only at great expense. The additive manufacturing method is suitable, in particular, for being able to produce an inner ring that is undivided in the axial direction and has complex recesses and/or through-openings. It is also obviously possible to produce the respective guide vanes and/or the securing element at least partially by means of an additive manufacturing method. In particular, it is possible in this way to produce the inner ring and the securing element and/or the guide vanes by joint fabrication, in particular in a single fabrication step.

In another advantageous embodiment of the guide vane system according to the invention, it is provided that at least one sealing element is arranged on the inner ring radially on the inner side. It is possible by means of this sealing element to seal off a flow space of the turbomachine with respect to a shaft of the turbomachine arranged radially on the inner side. Due to the form-fitting securing of the guide vanes on the inner ring, as already discussed, there is no cording or only an especially reduced cording. In this way, any wear of the sealing element during operation of the turbomachine is especially reduced. In this case, it is possible to provide a seal support at the inner ring radially on the inner side for holding the sealing element. This ensures a simple replacement of the sealing element.

In another advantageous embodiment of the guide vane system according to the invention, it is provided that the recess and/or the through-opening of the radially inner end region of the guide vane is designed at least in sections to correspond lengthwise to the securing element and/or the recess and/or the through-opening of the inner ring is designed at least in sections to correspond lengthwise to the securing element. In this way, the securing element can be supported especially reliably at the respective recesses and/or through-openings. Owing to the corresponding oblong designs of the recesses and/or through-openings and of the securing element, the guide vane is additionally held on the inner ring in an especially precise position, whereby the so-called cording is especially reduced.

A second aspect of the invention relates to a turbomachine, in particular an aircraft engine. In accordance with the invention, it is provided in this case that this turbomachine comprises at least one guide vane system according to a first aspect of the invention. The features and advantages ensuing from the use of the guide vane system according to the first aspect of the invention may be taken from the descriptions of the first aspect of the invention, with advantageous embodiments of the first aspect of the invention to be regarded as advantageous embodiments of the second aspect of the invention and vice versa.

A third aspect of the invention relates to a method for assembling a guide vane system for a turbomachine. In accordance with the invention, at least one guide vane that can be rotatably mounted around an adjustment axis, with a radial end region that has at least one recess and/or through-opening directed in the peripheral direction of the turbomachine in the installed position of the guide vane, an inner ring with a recess corresponding to the radial inner end region of the guide vane and with at least one recess and/or through-opening directed in the peripheral direction of the turbomachine, and a securing element designed as a oblong element are provided. Preferably, the guide vane can be rotatably mounted on the turbomachine in this case, in particular at an outer ring of the turbomachine or of a guide vane ring. In a further step, the insertion of the radially inner end region of the guide vane into the recess of the inner ring is provided. Afterwards, the securing element is inserted into the recess and/or into the through-opening of the inner ring and into the recess and/or into the through-opening of the guide vane for form-fitting securing of the arrangement of the guide vane on the inner ring. For this, it may be necessary, after insertion of the guide vane into the recess of the inner ring, to align said guide vane in such a way that the respective recesses and/or through-openings overlap at least to the extent that the securing element can pass through them.

Preferably, the securing element is pushed in. In particular, the securing element can be inserted into the respective recesses and/or through-openings in the peripheral direction. In this case, it can be provided that a securing element, designed as a securing wire, is adapted to the shape of the inner ring, which is curved in the peripheral direction, only by way of this insertion. Moreover, an adequately long securing element can be passed through a plurality of recesses and/or through-openings of a plurality of guide vanes, as a result of which they can be secured jointly using a single securing element.

The method according to the third aspect of the invention is thus suitable for assembling a guide vane system according to the first aspect of the invention, with it being possible to assemble the guide vane system in an especially simple manner. The method of assembly according to the third aspect of the invention can thus be used as a part of a method for assembling a turbomachine according to the second aspect of the invention. The features and advantages ensuing from the guide vane system according to the first aspect of the invention or from the turbomachine according to the second aspect of the invention may be taken from the descriptions of the first or second aspect of the invention, respectively, with advantageous embodiments of the first or the second aspect of the invention to be regarded as advantageous embodiments of the third aspect of the invention and vice versa.

BRIEF DESCRIPTION OF THE DRAWINGS

Further advantages, features, and details of the invention ensue from the following description of preferred exemplary embodiments of the invention as well as on the basis of the drawings. The features and combinations of features mentioned in the above description as well as the features and combinations of features mentioned below in the description of the figures and/or shown solely in the figures can be used not only in the respectively given combination, but also in other combinations or alone without departing from the scope of the invention.

Herein.

DESCRIPTION OF THE INVENTION

Figure 1:
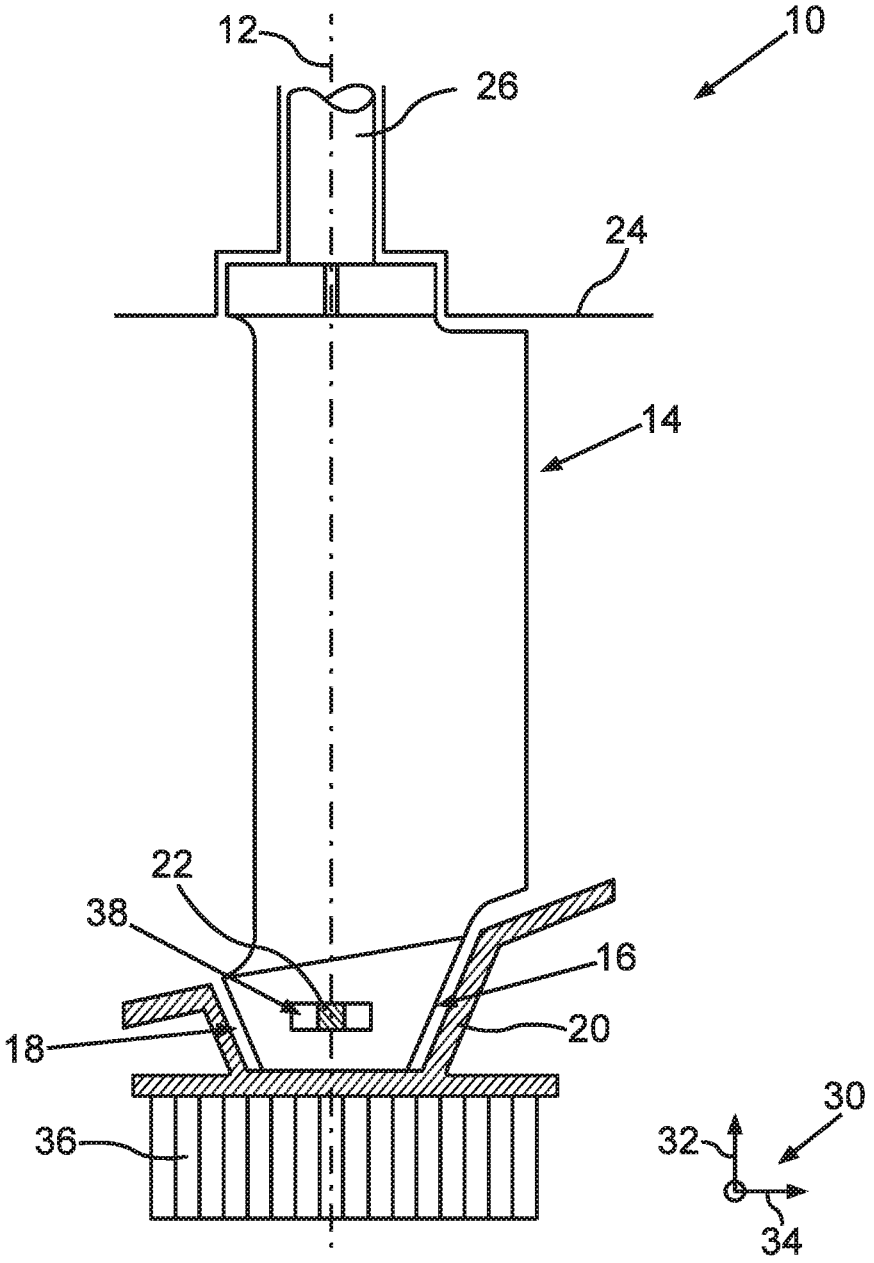
FIG. 1 shows, in a meridional section, a guide vane system for a turbomachine with at least one rotatably mounted guide vane, which is arranged on an inner ring, with this arrangement being secured in a form-fitting manner by means of a securing element.

FIG. 1 shows, in a meridional section, a guide vane system 10 for a turbomachine with at least one guide vane 14 that is rotatably mounted around an adjustment axis 12, said guide vane being arranged with a radially inner end region 16 in a corresponding recess 18 of an inner ring 20. In this case, the radially inner end region 16 is designed as a truncated cone. The arrangement of the guide vane 14 on the inner ring 20 is secured in this case in a form-fitting manner by means of a securing element 22. On account of this securing of the arrangement, it is prevented that the radially inner end region 16 of the guide vane 14 comes off the inner ring 20 or slips out of its recess 18, for example, due to so-called pump surges.

In the example shown, the guide vane system 10 has an outer ring 24, at which the guide vane 14 is rotatably mounted by means of a bearing journal 26. Respective adjustment devices for rotating the guide vane 14 around the adjustment axis 12, for example, can also be provided at the outer ring 24. Due to this rotation of the guide vane 14, it is possible to adapt the position thereof to a respective operating point of the turbomachine and thus to increase the efficiency of the turbomachine. Preferably, the turbomachine is designed as an aircraft engine in this case.

Figure 2:
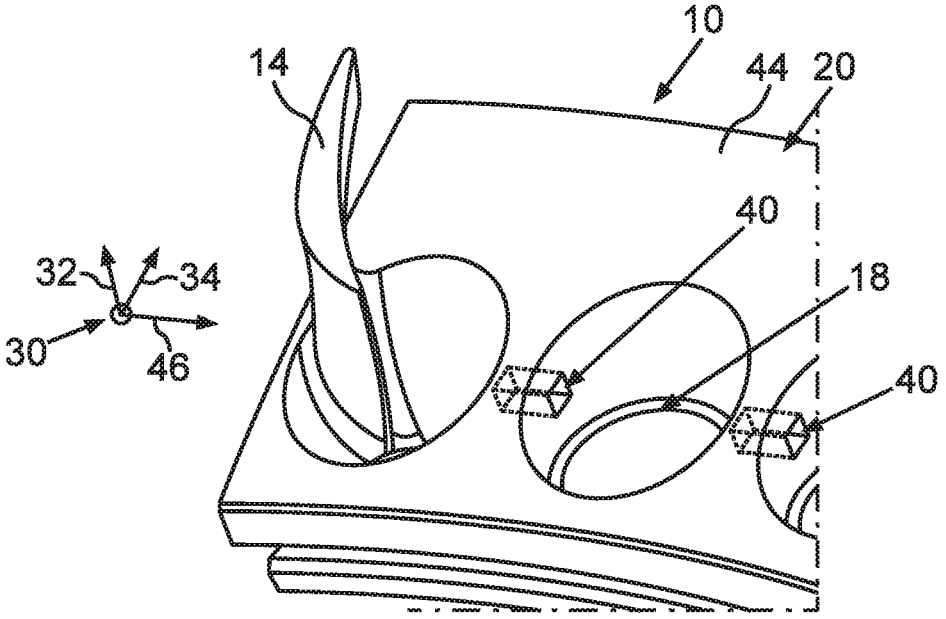
FIG. 2 shows, in a schematic perspective view in an excerpt, the guide vane system according to FIG. 1.

A coordinate system 30 is depicted in FIG. 1 for orientation. In this case, the arrow 32 indicates the radial direction outward from the turbomachine. The arrow 34 indicates the axial direction of the turbomachine. Because what is involved here is a meridional section, the peripheral direction of the turbomachine is directed inward or outward in the plane of the figure and thereby follows a curvature of the inner ring 20. In FIG. 2 to FIG. 6, the coordinate system 30 is also depicted. In FIG. 2, in this case, the peripheral direction of the turbomachine is indicated by the arrow 46.

The guide vane system 10 constitutes part of a so-called guide vane ring or a so-called guide wheel of the turbomachine. The guide vane ring comprises a large number of guide vanes 14 arranged in succession in the peripheral direction. The guide vane system 10 or the guide vane ring in this case is preferably a part of a high-pressure or low-pressure compressor of the turbomachine.

A sealing element 36 is provided radially at the inner ring 20 on the inner side. It is possible by means of this sealing element 36 to seal off a flow space, which is delimited by the outer ring 24 and the inner ring 20, with respect to other parts of the turbomachine. The sealing element 36 in this case can be designed, for example, as a sweeping brush seal, by means of which this flow space is sealed at a rotating shaft of the turbomachine.

In the exemplary embodiment illustrated, the securing element 22 is designed as an oblong element, which is arranged at least in a through-opening 38 of the radially inner end region 16 of the guide vane 14 directed in the peripheral direction of the turbomachine. As a result of the alignment of the securing element 22 in the peripheral direction and, in addition, in respective recesses and/or through-openings 40 corresponding to it (see also FIG. 2), a single or joint securing of one or a plurality of guide vanes 14 on the inner ring 20 is possible by means of a single securing element 22. In this way, this securing is assembled in an especially simple manner and requires very few parts. At the same time, the inner ring 20 is held especially reliably at the guide vane 14 on account of the secured arrangement, and respective transient thermal effects, which are also referred to as cording, are reduced. In this way, any wear of the sealing element 36 is especially small during operation of the turbomachine.

The guide vanes 14 and the inner ring 20 are radially supported against each other outward and/or inward via the securing element 22. The through-opening 40 or the through-openings 40 of the inner ring 20 in this case are shown in the schematic perspective view of the guide vane system 10 according to FIG. 2. It can be seen there that the through-opening 38 of the guide vane 14 and the through-opening 40 of the inner ring 20 are aligned with respect to each other for the assembly or for an insertion of the securing element 22. Because each of the through-openings 38, 40 is directed in the peripheral direction, preferably no additional axial leakage occurs owing to the securing of the arrangement of the guide vane system 10.

The exemplary embodiment of the guide vane system 10 shown in FIG. 2 shows through-openings 40 of the inner ring 20, which have a rectangular cross section. Correspondingly, a securing element 22, which is not shown here, also preferably has a rectangular cross section, so as to be able to be supported especially well in the through-opening 40. The through-opening 38 of the guide vane 14 can also have a rectangular cross section. The cross sections 38, 40 of the through-openings 38, 40 and of the securing element 22 in this case are designed in such a way that, overall at least, they exhibit a minimum play in order to ensure the variable adjustment of the guide vane 14. Alternatively, the through-openings 38, 40 and/or the securing element 22 can also have a round cross section. A round cross section leads in this case to especially small stress peaks during a load, whereby the guide vane system 10 is especially robust. Other cross-sectional shapes for the through-openings 38, 40 and the securing element 22 can also be chosen.

Figure 3:
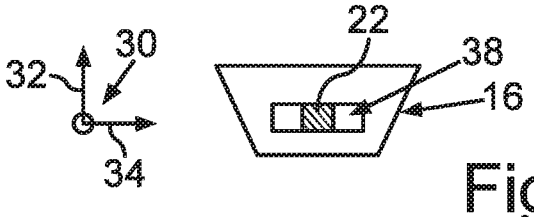
FIGS. 3 to 6 show, in schematic sectional views in excerpts, alternative embodiments of the guide vane and of the securing element for the guide vane system according to FIG. 1.

FIGS. 3 to 6 show, in schematic sectional view, the radially inner end region 16 of the guide vane 14 with the securing element 22 arranged there in various embodiments. In this case, FIG. 3 shows the embodiment according to FIG. 1. Here, the securing element 22, as well as the through-opening 38, has a rectangular design in the radially inner end region 16 of the guide vane 14. The cross section of the through-opening 38 is enlarged in the axial direction in comparison to the cross section of the securing element 22. As a result, the variable adjustment of the guide vane 14 is ensured.

Figure 4:
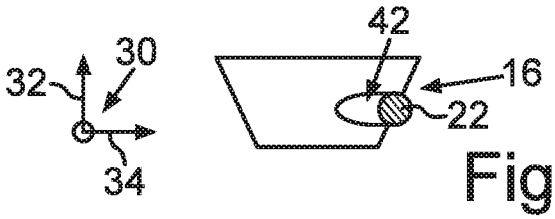

FIG. 4 shows an embodiment in which the securing element 22 is arranged in a recess 42 in the guide vane 14. In the case of the recess 42 according to FIG. 4, what is involved is a groove that runs on the outside at least partially around the radially inner end region 16 of the guide vane 14. A corresponding groove for accommodating another region of the securing element 22 is formed (not illustrated) on the inner side of the recess 18. As a result of this design, it is ensured, in turn, that the guide vane 14 can be rotated around the adjustment axis 12, without this rotation being blocked by the securing element 22. The securing element 22 additionally has a round cross section.

Figure 5:
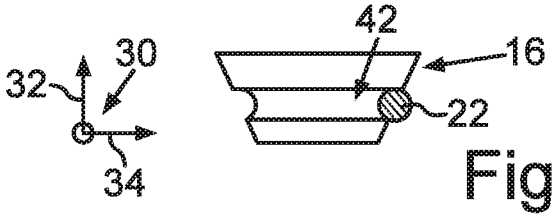

FIG. 5 shows a recess 42, which is formed as a groove that runs completely around the radially inner end region 16. A corresponding groove for accommodating another region of the securing element 22 is formed at the inner side of the recess 18 (not illustrated). The completely encircling groove does not restrict an adjustment range when the guide vane 14 is rotated. The securing element 22 additionally has a round cross section.

Figure 6:
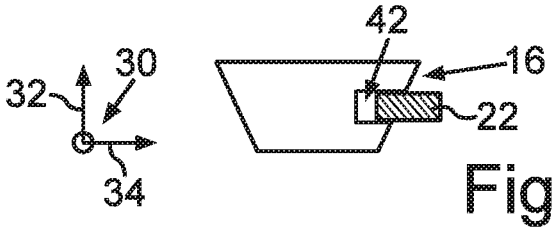

FIG. 6 shows another embodiment, in which the recess 42 is designed similarly to the recess 42 according to FIG. 4. In the embodiment according to FIG. 6, however, the recess 42 is rectangular in design. Here, too, the securing element 22 is designed to be rectangular in cross section.

An inner ring segment 44 of the inner ring 20 is shown in FIG. 2. At least two of these inner ring segments 44 form the inner ring 20. The inner ring 20 is divided in the peripheral direction. The securing element 22 in the case of the divided inner ring 20 is guided in a simple manner in the peripheral direction through the respective through-openings 40 of the inner ring segment 44. In this case, the guide vanes 14 have been arranged beforehand with their radially inner end region 16 in the recess 18 of the inner ring segment 44. In this case, one securing element 22 can be provided for each inner ring segment 44. Also possible is the use of a single, encircling securing element 22.

For example, it is possible to push a securing wire, which is round or rectangular in cross section, as securing element 22, over a sector of up to 180 degrees in the peripheral direction through the inner ring 20 or an inner ring segment 44 and to join it in a form-fitting manner with the truncated-cone-shaped bearing journal of the guide vanes 14. In this case, this securing wire can be provided as a straight wire and only adapted to a curvature of the inner ring 20 when it is threaded.

Instead of the through-openings 40, the inner ring 20 or the inner ring segments 44 can also have respective recesses 42 in the form of a groove, for example. This groove could be directed radially inward, for example, as a result of which a radial outer-side support of the securing element 22 in such a groove of the inner ring 20 is then further made possible. In general, a shape and/or a cross section of a through-opening 40 or of a recess 42 of the inner ring 20 can correspond to the shapes and/or cross sections of the securing element 22 and/or of the recess 42 of the guide vane 14 and/or of the through-opening 38 of the guide vane 14. Reference is made to FIG. 3 to FIG. 6 for exemplary shapes and cross sections.

Preferably, the inner ring 20 or the inner ring segments 44 is or are produced by means of an additive manufacturing method. For example, it is possible for this purpose to use a so-called selective laser melting or selective electron-beam melting method. In this way, an inner ring 20 can be produced with geometries that cannot be produced using conventional methods. In particular, it is possible to directly provide respective recesses and/or through-openings 40 for the inner ring 20. By contrast, the through-openings 40 cannot be introduced, for example, by conventional milling or drilling into the inner ring 20 in the case of an axially undivided inner ring 20, in particular on account of the curvature of the inner ring 20.

What is claimed is:

1. A guide vane system for a turbomachine with at least one guide vane, which is rotatably mounted around an adjustment axis and is arranged with a radially inner end region in a corresponding recess of an inner ring, wherein the arrangement of the guide vane on the inner ring is secured by a securing element in a form-fitting manner, wherein the securing element is an oblong element, which is arranged at least in a recess and/or through-opening of the radially inner end region of the guide vane directed in the peripheral direction of the turbomachine and is arranged at least in a recess and/or through-opening of the inner ring directed in the peripheral direction of the turbomachine.

2. The guide vane system according to claim 1, wherein at least two guide vanes of the guide vane system are secured by a common securing element.

3. The guide vane system according to claim 1, wherein the recess of the guide vane is formed as a groove that runs on the outside at least partially around the radially inner end region of the guide vane.

4. The guide vane system according to claim 1, wherein the securing element is a securing wire that is round or square in cross section and runs in the peripheral direction.

5. The guide vane system according to claim 1, wherein the inner ring is undivided in the axial direction of the turbomachine.

6. The guide vane system according to claim 1, wherein the inner ring is divided into at least two inner ring segments in the peripheral direction of the turbomachine.

7. The guide vane system according to claim 6, wherein one securing element is provided for each inner ring segment.

8. The guide vane system according to claim 1, wherein the inner ring is produced at least partially by an additive manufacturing method.

9. The guide vane system according to claim 1, wherein at least one sealing element is arranged at the inner ring radially on the inner side.

10. The guide vane system according to claim 1, wherein the recess and/or the through-opening of the radially inner end region of the guide vane have or has an oblong form, at least in sections, corresponding to the securing element, and/or the recess and/or the through-opening of the inner ring has an oblong form, at least in sections, corresponding to the securing element.

11. The guide vane system according to claim 1, wherein the guide vane system is configured and arranged in an aircraft engine.

12. A method for assembling a guide vane system for a turbomachine, comprising the steps of:

providing at least one a guide vane that can be rotatably mounted around an adjustment axis and that has a radially inner end region having at least one recess and/or through-opening directed, in the installed position of the guide vane, in the peripheral direction of the turbomachine, providing an inner ring with a recess corresponding to the radially inner end region of the guide vane and with at least one recess and/or through-opening directed in the peripheral direction of the turbomachine, and providing a securing element formed as an oblong element;

inserting the radially inner end region of the guide vane into the recess of the inner ring; and inserting the securing element into the recess and/or into the through-opening of the inner ring and into the recess and/or into the through-opening of the guide vane for the form-fitting securing of the arrangement of the guide vane on the inner ring.

* * * * *